US006923645B1

(12) United States Patent
Chiu et al.

(10) Patent No.: US 6,923,645 B1
(45) Date of Patent: Aug. 2, 2005

(54) GAS MIXING DEVICE

(76) Inventors: Teng-Mao Chiu, P.O. Box 2-10, Tainan City (TW); Chin-Hsiang Lin, P.O. Box 2-10, Tainan City (TW)

( * ) Notice: Subject to any disclaimer, the term of this patent is extended or adjusted under 35 U.S.C. 154(b) by 12 days.

(21) Appl. No.: 10/758,450

(22) Filed: Jan. 12, 2004

(51) Int. Cl.[7] ..... F23D 14/28
(52) U.S. Cl. ..... 431/344; 431/345; 431/346
(58) Field of Search ..... 431/344, 345, 431/346, 354, 356; 202/183, 197

(56) References Cited

U.S. PATENT DOCUMENTS 2,022,513 A * 11/1935 Macchi ..... 239/417.3
4,125,360 A * 11/1978 Culbertson ..... 431/187
5,170,727 A * 12/1992 Nielsen ..... 110/346
5,470,225 A * 11/1995 Fujiwara et al. ..... 431/215
6,446,597 B1 * 9/2002 McAlister ..... 123/297

* cited by examiner

*Primary Examiner*—Stephen Gravini

(57) ABSTRACT

A gas-mixing device includes a store tank, a mixing chamber provided in the store tank, an air intake tube provided in the mixing chamber and having an intake, and an outlet tube connected with the mixing chamber. Properly pressured air is pumped through the air intake tube in the store tank to add pressure and vaporize liquid fuel oil in the store tank. Vaporized fuel oil is sent to a nozzle through the fuel oil outlet tube. An air outlet valve is provided in the store tank for pressured air therein to flow through into the nozzle, wherein vaporized fuel oil is mixed with pressured air and further intensely vaporized to produce further vaporizing and pressure-adding function for use in a burning appliance and installation.

4 Claims, 7 Drawing Sheets

GAS MIXING DEVICE

FIELD OF THE INVENTION

This invention relates to a gas-mixing device, particularly to one applicable to a heavy oil burning system, for swiftly starting and operating the heavy oil burning system without preheating or standby.

BACKGROUND OF THE INVENTION

A first conventional fuel oil gasifying system disclosed in a Taiwan patent of No. 431575 for a gas burning system shown in FIG. 1 includes a tank (A) provided with a check window (A1), a gas outlet (A2), a gas valve (A3), a valve cap (A30) screwed on the tank (A), a joint (A31) with a valve (A32) connected with the valve cap (A30). The valve (A32) has a gas passageway (A33) with its upper end communicating with the joint (A31) and with its lower end screwed with an inner pipe (A34) extending down near to the bottom of the tank (A). The inner pipe (A34) has an upper end portion with a larger diameter than that of the inner pipe itself for a valve stop (A35) to be positioned therein in a normally-open condition by its weight to keep the intake passageway (A33) normally open, with its bottom provided with a gasket to lift a bit to keep the upper end portion normally communicating with the inner pipe itself. Further, an outer pipe (A36) is provided to be located lengthwise outside of the inner pipe (A34), having a bit shorter length than the inner pipe (A34) but a larger diameter to define an annular passageway between the two pipes (A34) and (A36). Then an electric pump (A37) is connected with the gas valve (A3) by means of a rubber tube (A360) to send compressed air through the gas valve (A3) into the tank (A) to gasifying the fuel oil in the tank (A) and let it flow out of the outlet.

Next, a second conventional gas supplying system disclosed in a Taiwan patent of No. 452052 shown in FIG. 2 includes a tank (B) provided with a guide tube (B0), a backflow stop valve (B1) fixed on the guide tube (B0), a cross-shaped branch tube (B2) connected with the lower end of the guide tube (B0), a bubble stone fixed in each end of the cross-shaped tube (B2), and a controller (B3) connected with the tank (B) with two tubes. The controller (B3) includes a pressure control circuit and a drive motor. The motor is connected with a switch valve and communicates with an outer guide tube. The pressure control circuit stabilized the gas pressure in the tank (B) at a definite value. Thus, when compressed air is sent through the outer guide tube and into the guide tube (B0) in the tank (B), and then passes through the bubble stones to force the liquid fuel oil to bubble and let the liquid gas vaporize and be sent out for burning.

It can be seen that the second conventional case and the first conventional case are almost the same, using a electric pump or a motor for adding pressure to the fuel oil for vaporizing and sending it out for burning.

However, the first and the second conventional case use the way of adding pressure to the tank and mixing air and gas for a burning appliance to burn, with first vaporization and subsequent burning suitable for common gas or comparatively fluidly fuel oil, but not for low fluidly heavy oil, which needs preliminary heating and standby.

SUMMARY OF THE INVENTION

This invention has been devised to offer a gas-mixing device improving drawbacks of the conventional ones mentioned above.

A first purpose of the invention is to offer a gas-mixing device applicable for a heavy oil burning system with no preliminary heating such as a steam boiler or any heavy oil burning system.

A second purpose of the invention is to offer a gas-mixing device applicable for a low fluidly heavy oil burning system, which can economize fuel oil and have high efficiency in burning, attaining complete burning and reducing air pollution.

The invention has the following features.

1. It has a tank provided with a mixing chamber, with an intake tube connected with the mixing chamber and having an intake, and with an outlet tube connected with the air chamber. Then compressed air is pumped in the tank through the air intake tube for adding pressure to the liquid fuel oil to vaporize it, and the vaporized fuel oil is sent through the outlet tube to a nozzle, which then adds pressure again to further intensely vaporizing for a burning appliance or installation to burn.

2. The nozzle can add pressure and vaporize the vaporized fuel oil in the store tank once again, upgrading burning efficiency and economizing fuel oil.

3. The nozzle sprays vaporized fuel oil mixed air in a radial direction, further enhancing burning efficiency and further economizing fuel oil.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
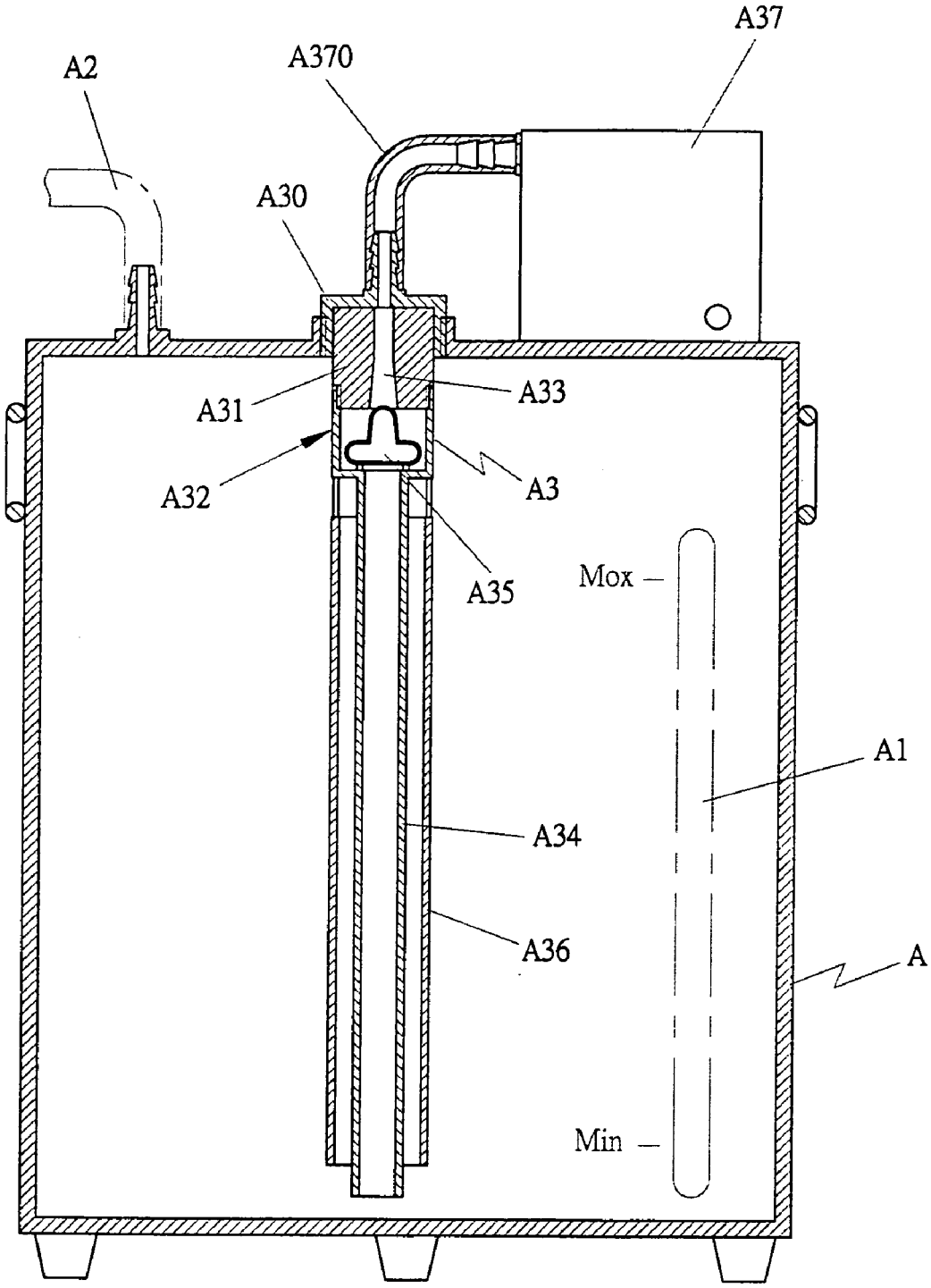
FIG 1 (PRIOR ART)
FIG. 1 is a cross-sectional view of a first conventional gas-mixing device.
Figure 2:
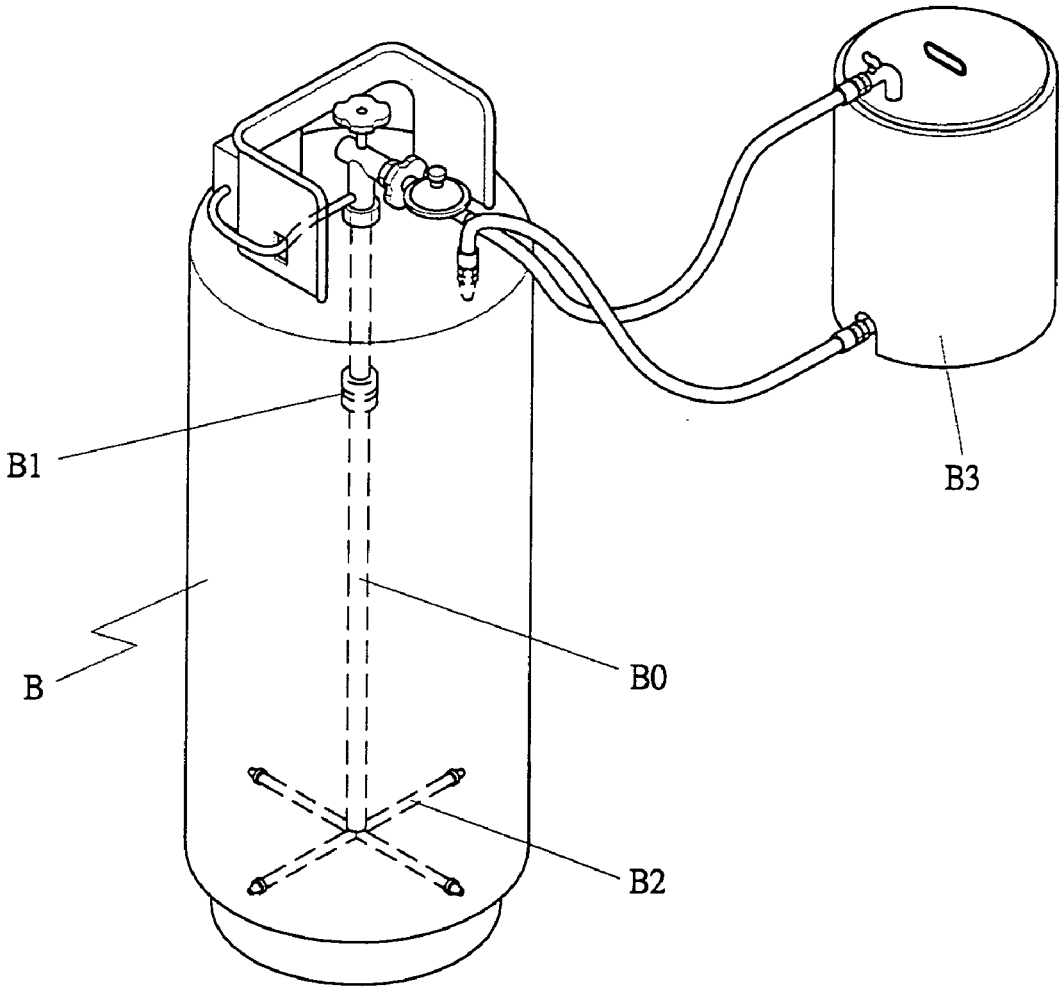
FIG 2 (PRIOR ART)
FIG. 2 is a perspective view of a second conventional gas-mixing device.
Figure 3:
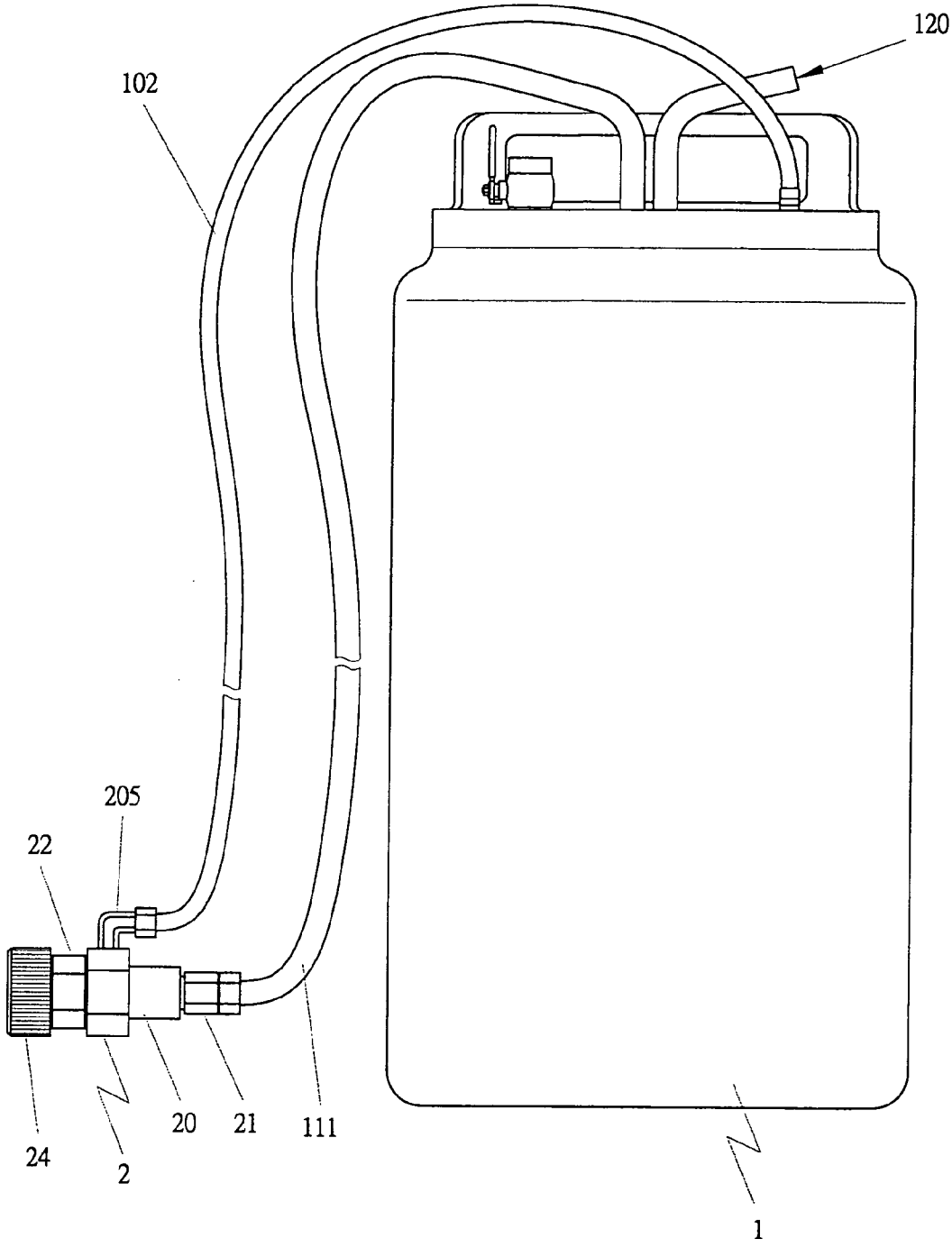
FIG. 3 is a side view of a gas-mixing device in the present invention.
Figure 4:
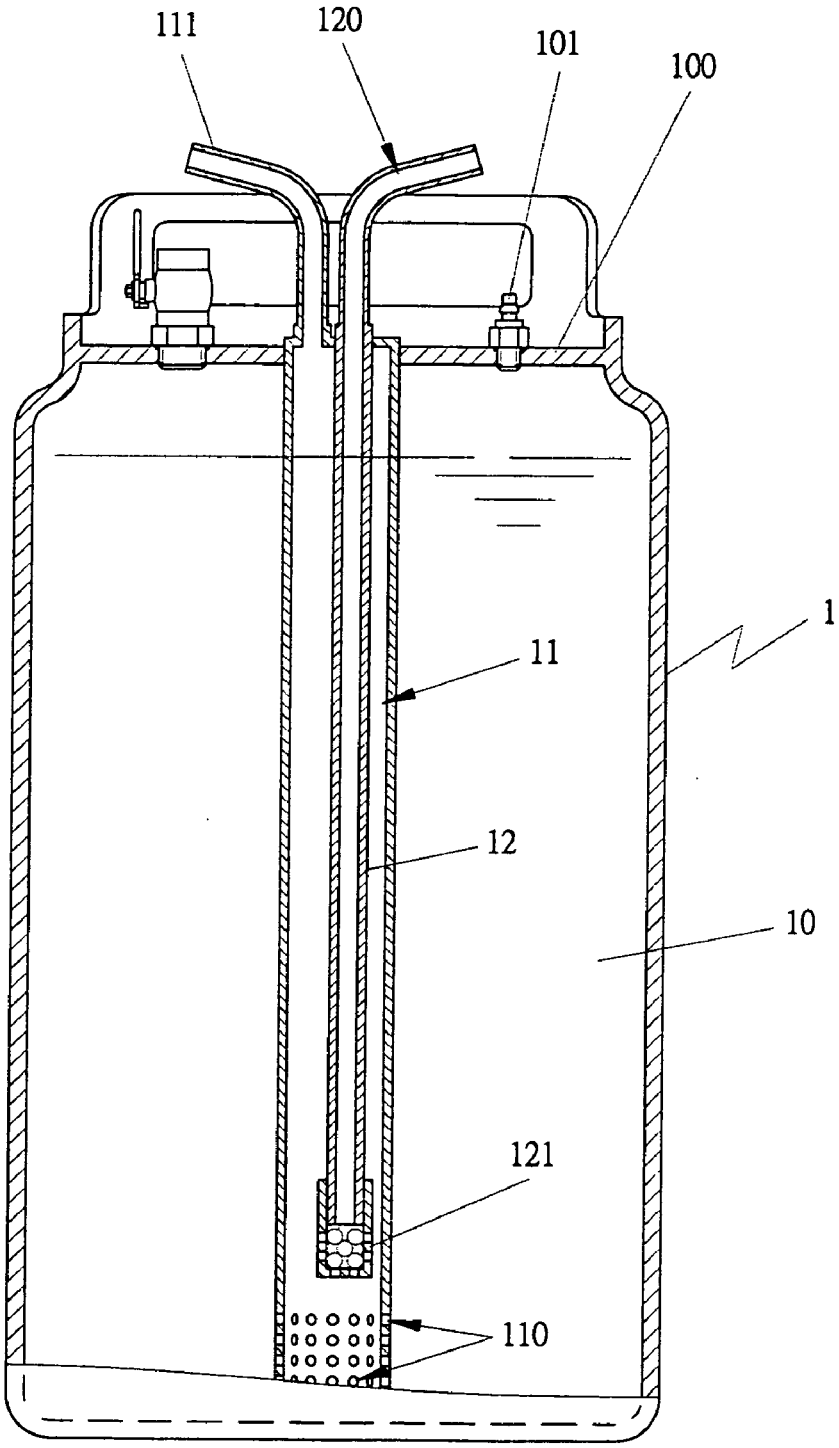
FIG. 4 is a cross-sectional view of the gas-mixing device in the present invention.
Figure 5:
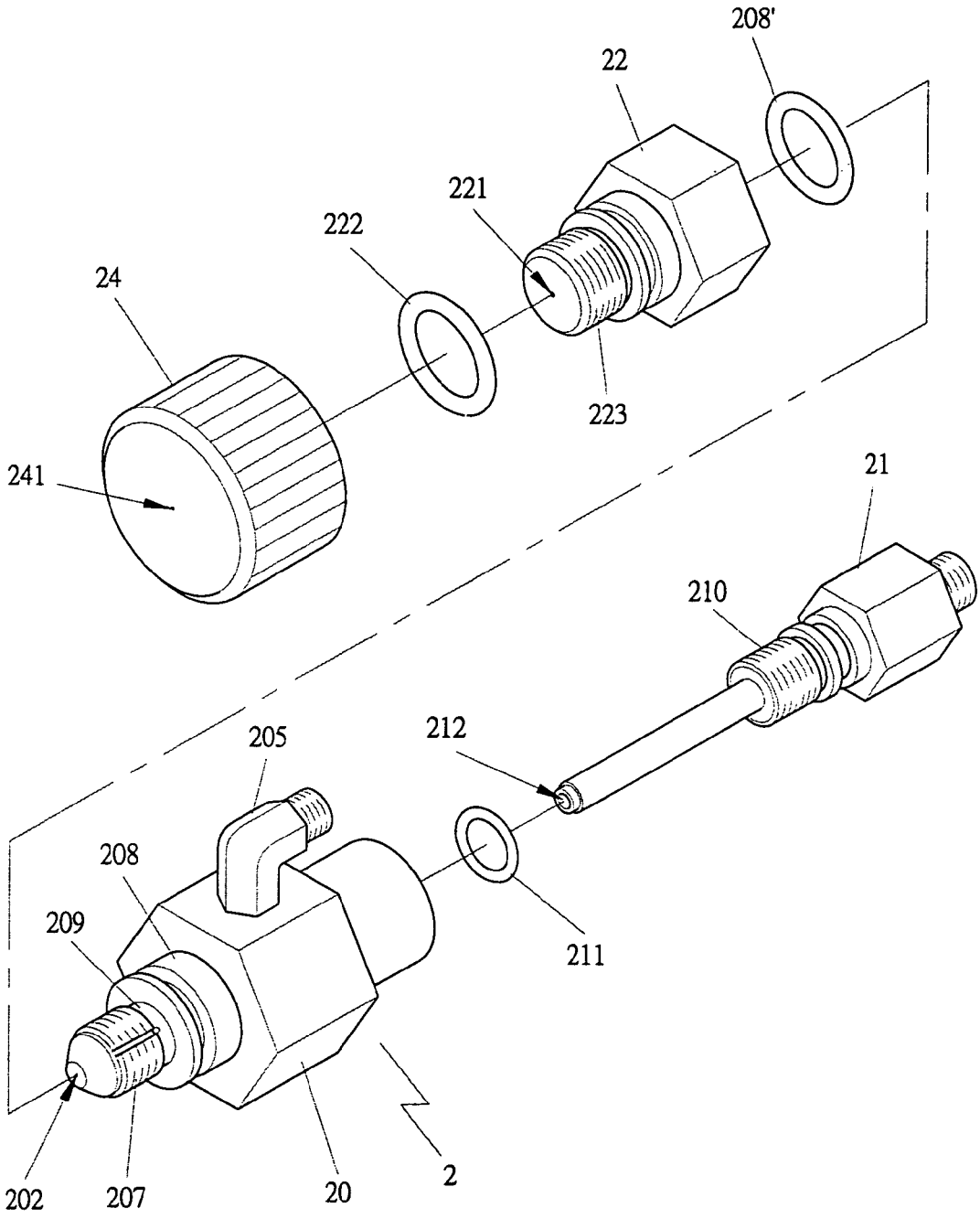
FIG. 5 is an exploded perspective view of a nozzle in the present invention.
Figure 6:
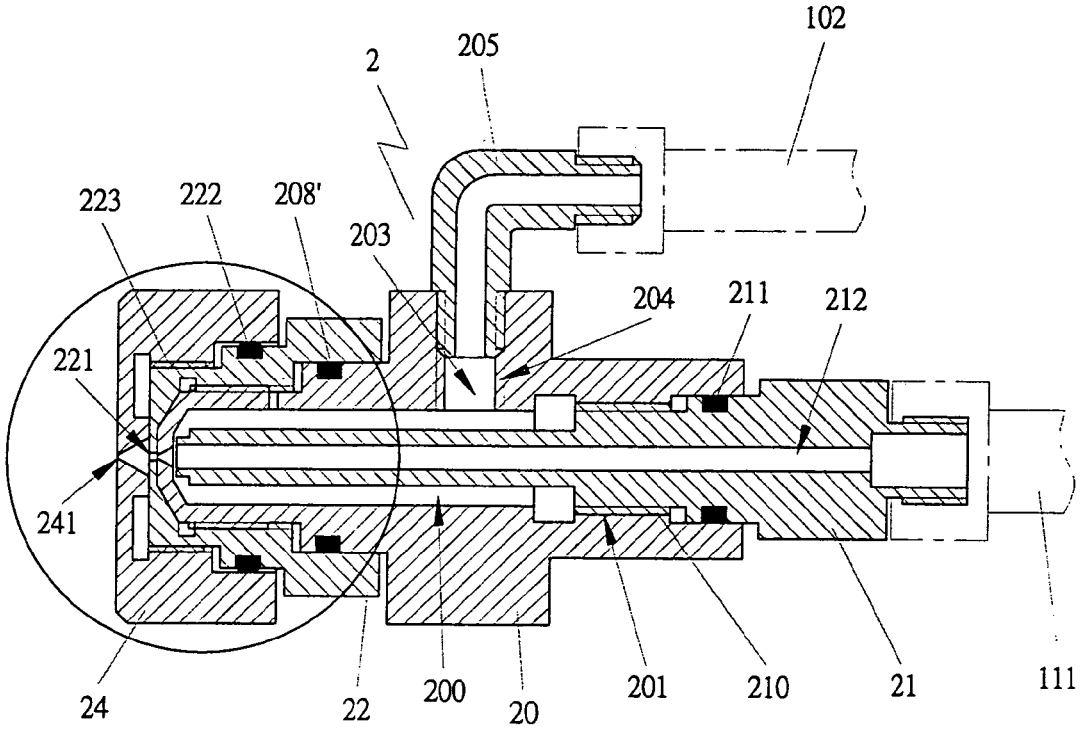
FIG. 6 is a cross-sectional view of the nozzle in the present invention.
Figure 7:
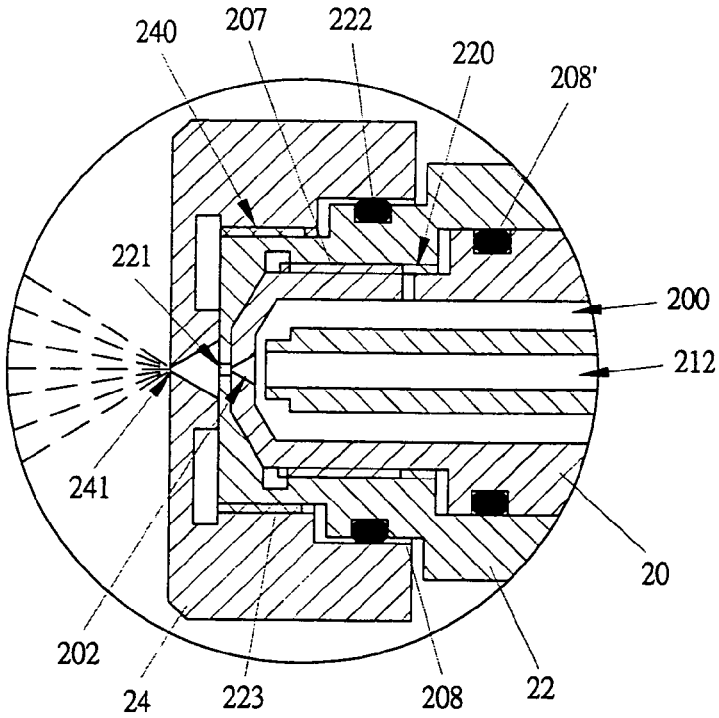
FIG. 7 is a partial magnified cross-sectional view of the nozzle in the present invention; and, FIG. 8 is a perspective view of the nozzle in the present invention.
Figure 8:
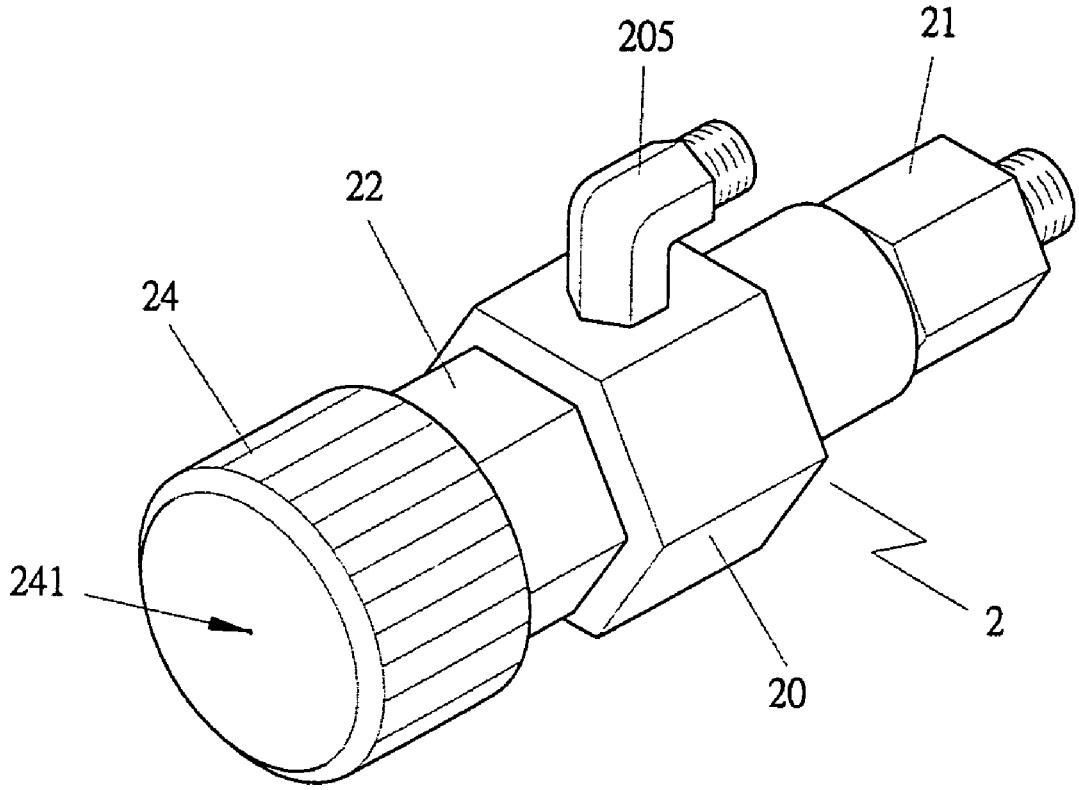

A preferred embodiment of a gas-mixing device in the present invention, as shown in FIGS. 3 and 4, includes a store tank 1, a mixing chamber 11, an air intake tube 12 and a nozzle 3.

The store tank 1 has an interior hollow 10, an upper wall 100 defining the interior hollow 10, an air outlet valve 101 fixed in the upper wall 100, and a air outlet tube 102 connected with the air outlet valve 101. So pressured air in the store tank 1 can be sent through the air valve 101 and the air outlet tube 102 to the nozzle 2. Thus air with the same pressure as the vaporized fuel oil coming from the store tank is supplied to the nozzle 2, preventing back pressure caused in either of the two sources from happing so as to stabilize the pressure in the nozzle.

The mixing chamber 11 is formed in the interior hollow 10, extending from the upper wall 100 down to near the bottom of the store tank 1, having a lower section wall bored with plural holes 110 for liquid fuel oil in the store tank 1 to flow through into the mixing chamber 11. Further a fuel oil outlet tube 111 is connected with the upper end of the mixing chamber 11 for vaporized fuel oil to flow through to the nozzle 2.

The air intake tube 12 is positioned vertically in the mixing chamber 11, having an upper end 120 exposed out of the store tank 1 to be connected with a pressurizing appliance such as an electric or an air pump to send pressured air into the mixing chamber 11. Further, an air bubble producer 121 is provided in the bottom of the air intake tube 122, having bubble stones for air to pass through. Then air becomes substantially even and fusible air bubbles to enter the mixing chamber 11 to vaporize the fuel oil in the store tank 1.

The nozzle 2 shown in FIGS. 5, 6, 7 and 8 is connected with both the fuel oil outlet tube 111 and the air outlet tube 102 so that the pressured vaporized fuel oil may be further intensely vaporized in the nozzle 2 and then sent in a burning appliance. The nozzle 2 has a nozzle body 20, a lengthwise chamber 200, female threads 201 formed in an inner wall of a rear portion, a cone-shaped outlet 202 formed in a front end, a lateral hole 203 bored in an intermediate upper wall of the lengthwise chamber 200, and female threads 204 formed in the lateral hole 203 to engage with an air connect tube 205. The air connect tube 205 is then connected with the air outlet tube 102 of the store tank 1 to let pressured air in the store tank 1 pass through to the lengthwise chamber 200. The nozzle body 20 further has male threads 207 on the front section, a small-diameter section formed in the foremost end section 209 and a larger-diameter section 208 behind the foremost end section 209, an O-shaped ring 208' fitting in an annular groove in the larger-diameter section 208 to prevent leakage and backflow.

Further, a pressure-adding tube 21 is positioned in the lengthwise chamber 200 of the nozzle 2, and connected with the vapor fuel outlet tube 111 for vaporized fuel oil in the store tank 1 to flow to the nozzle 2. The pressure-adding tube 21 has male threads 210 to engage with the female threads 204 of the nozzle body 20, an O-shaped ring fitted around the outer surface to prevent vapor fuel oil from leaking out or backflow, and a center hole 212 for vaporized fuel oil in the store tank 1 to flow through into the nozzle 2, and also mixed with air coming from the store tank 1 to further intensely vaporizing the vaporized fuel oil in the lengthwise chamber 200 for burning more easily.

Further, a pressure cylinder 22 is provided to have female threads 220 to engage with the male threads 207 of the nozzle body 20, an outlet 221 with a diameter preferably smaller than that of the cone-shaped outlet 202 of the nozzle body 20 to produce pressure-adding function and effect, an O-shaped ring 222 around the outer surface, and male threads 223 on the outer surface.

Further, a cap 24 is provided to have female threads 240 to engage with the male threads 223 of the pressure cylinder 22, a cone-shaped outlet 241 in the center of the outer end surface and having a smaller diameter than that of the outlet 221 of the pressure-adding cylinder 22 for producing the third time of vaporizing function and effect so that the thrice vaporized fuel oil may be sprayed out through both the cap 24 and the nozzle 2 in a radial direction for use by a burning appliance or installation with swift burning.

In short, The gas mixing device according to the invention can repeat several times pressure adding and vaporizing operation to completely vaporize heavy oil to be burned without preliminary heating, economizing fuel oil as much as 52% proved in practical experiments.

While the preferred embodiment of the invention has been described above, it will be recognized and understood that various modifications may be made therein and the appended claims are intended to cover all such modifications that may fall within the spirit and scope of the invention.

What is claimed is:

1. A gas mixing device comprising:

a store tank having an interior hollow, said interior hollow defined by an upper wall, an annular wall and a bottom wall, an air outlet valve provided in said upper wall, an air outlet tube connected with said air outlet valve:

a mixing chamber provided in said interior hollow of said store tank, said mixing chamber extending down from said upper wall to near the bottom of said store tank, plural small holes formed in an annular wall near the lower end of said mixing chamber, a vaporized fuel oil outlet tube connected with an upper end of said mixing chamber:

an intake tube provided to extend down from the upper end of said mixing chamber, said intake tube having an intake, an bubble producer provided at a lower end of said intake tube and having plural bubble stones therein: and, a nozzle connected both with said air outlet tube and said vaporized fuel oil outlet tube so as to send both vaporized fuel oil and pressured air synchronously to said nozzle and then to a burning appliance and installation.

2. A gas mixing device comprising a store tank and a nozzle, said nozzle comprising:

a nozzle body provided with a lengthwise chamber, female threads formed in an inner wall of a partial rear portion of said lengthwise chamber, a cone-shaped outlet formed in a front end of said nozzle body, a lateral hole formed at an intermediate wall of said lengthwise chamber and formed with male threads, an air connect tube connected and engaging with said male threads of said lateral hole, male threads formed on an outer surface of said nozzle body, a small-diameter section and a large-diameter section behind said small-diameter section formed in a front portion of said nozzle body, an O-shaped ring fitting around said large-diameter section:

a pressure-adding tube positioned in said lengthwise chamber of said nozzle body, said pressure-adding tube having male threads to engage with said female threads of said nozzle body, a center lengthwise hole and an O-shaped ring fitting around its outer surface:

a pressure-adding cylinder having female threads to engage with said male threads of said nozzle body, an outlet, male threads and an O-shaped ring fitting around its outer surface: and, a cap having female threads to engage with said male threads of said pressure-adding cylinder, a cone-shaped outlet formed in a front end surface of said cap, vaporized fuel oil sprayed out in a radial direction after passing through said cap and supplied to a burning appliance and installation.

3. The gas mixing device as claimed in claim 2, wherein said outlet of said pressure-adding cylinder has a diameter smaller than that of said cone-shaped outlet of said nozzle body.

4. The gas-mixing device as claimed in claim 2, said cap has said cone-shaped outlet with a diameter smaller than that of said outlet of said pressure-adding cylinder for producing pressure adding and vaporizing effect.

* * * * *